US005168546A

United States Patent [19]

Laperriere et al.

[11] Patent Number: 5,168,546

[45] Date of Patent: Dec. 1, 1992

[54] DEVICE FOR HEATING THE BACTERIAL PROLIFERATION ZONE OF A WATER HEATER TO PREVENT LEGIONELLOSIS

[75] Inventors: André Laperriere, Trois Rivières; Raynald Brassard; Alain Moreau, both of Shawinigan, all of Canada

[73] Assignee: Hydro Quebec, Montreal, Canada

[21] Appl. No.: 696,572

[22] Filed: May 8, 1991

[30] Foreign Application Priority Data

Nov. 28, 1990 [CA] Canada ..... 2030976

[51] Int. Cl.[5] ..... F24H 1/20; H05B 1/02; C02F 1/02; F24D 17/00

[52] U.S. Cl. ..... 392/454; 122/13.2; 126/361; 219/535; 392/459

[58] Field of Search ..... 392/449–495; 126/361, 362; 122/13 R, 13 A; 219/535

[56] References Cited

U.S. PATENT DOCUMENTS

| | | | |
|---|---|---|---|
| 1,301,995 | 4/1919 | Arthur | 392/459 |
| 1,892,557 | 12/1932 | McCormick | 392/454 |
| 2,423,488 | 7/1947 | Dowe | 392/459 X |
| 2,510,456 | 6/1950 | Biebel | 392/459 |
| 2,545,653 | 3/1951 | Desloge | 219/535 X |
| 3,353,002 | 11/1967 | Macoicz et al. | 392/454 |
| 3,890,486 | 6/1975 | Fitzgerald | 219/523 |
| 4,889,973 | 12/1989 | Farinacci et al. | 219/528 |
| 4,940,024 | 7/1990 | Grabietz | 122/13 R |

FOREIGN PATENT DOCUMENTS

| | | | |
|---|---|---|---|
| 334797 | 9/1989 | European Pat. Off. | 392/449 |
| 3831152 | 3/1990 | Fed. Rep. of Germany | 392/449 |
| 3902113 | 7/1990 | Fed. Rep. of Germany | 392/449 |
| WO89/3807 | 5/1989 | PCT Int'l Appl. | 392/449 |

*Primary Examiner*—Anthony Bartis
*Attorney, Agent, or Firm*—Foley & Lardner

[57] ABSTRACT

A domestic electric water heater comprises a cylindrical tank having a vertical wall and an inwardly curved bottom, the latter defining with the vertical wall an annular stagnant water zone susceptible of bacterial contamination by, for example, legionella bacteria. The tank is provided with an upper immersion heating element and a lower immersion heating element, the latter being located above to the annular zone of contamination. The tank further comprises an outer electric heating element mounted on the outer surface of the vertical wall at the level of the contamination zone and below the lower immersion element. This outer heating element is capable of bringing water in the contamination zone to a temperature sufficient to eliminate the danger of such bacterial contamination, the temperature being in the order of 46° C.

11 Claims, 5 Drawing Sheets

GROWTH OF LEGIONELLOSIS VERSUS TEMPERATURE

TIME NECESSARY FOR THE DESTRUCTION OF 90° LEGIONELLOSIS VERSUS TEMPERATURE

DEVICE FOR HEATING THE BACTERIAL PROLIFERATION ZONE OF A WATER HEATER TO PREVENT LEGIONELLOSIS

BACKGROUND OF THE INVENTION

1. Field of the Invention:

The present invention relates to a domestic electric water heater which is altered in a way such as to allow control of bacterial contamination, particularly the elimination of the Legionella pneumophila, while retaining a good power efficiency.

2. Description of the Prior Art

Since it was discovered, at the Bellevue Stratford Hotel in Philadelphia (1976), that the Legionella pneumophila, commonly called the legionellosis, could cause serious infections in humans, numerous studies have been made in order to understand better the agents having an effect upon the proliferation of this bacterium which is found, as it has since been discovered, particularly at the bottom of domestic electric water heaters. It is, on the other hand, known that the legionellosis, like many other bacteria, does not grow nor survive at temperatures above 46° C.

The Applicant has conducted numerous studies in order to determine the parameters involved in the growth of the legionellosis bacterium inside domestic electric water heaters. Following the results obtained, the inventors have carried out works in order to perfect and test certain minor and low cost changes to be made to present-day water heaters which are most likely to reduce and practically eliminate bacterial contamination. These research works have, among others, shown that:

the temperature distribution in a conventional domestic water heater can explain the bacterium proliferation;

the bottom of the present-day water heater never exceeds 40° C. even when there is no hot water consumption. This temperature corresponds to a zone of bacterial proliferation. A greater water consumption has the effect of holding the bottom of the water heater at a lower mean temperature which is nevertheless located within the zone of bacterial proliferation;

stratification of the temperature at the bottom of the tank is notable;

it is difficult to increase the temperature at the bottom of the tank when there is no water consumption;

by increasing the temperature at the bottom of the tank through a recirculation pump, the conditions favorable to the legionellosis do not exist. This solution is however costly and not very reliable;

considering the noted stratification phenomenon, the temperature at the bottom of the tank does not increase proportionately even when the temperature set on the thermostats of the heating elements is increased so that the use of a mixing valve at 70° C. does not appear promising, based on the results of thermal fields. Besides, this has also been confirmed by bacterial studies;

insulating the bottom and changing the position of the thermostat do not appear to be the most promising techniques; and by raising to 70° C. the water temperature inside the tank (presently at 60° C. in a conventional water heater) it is not possible to destroy the bacterium, the temperature at the bottom of the tank remaining below 60° C.; by increasing it to 80° C., there is practically no more legionellosis at the bottom of the tank.

The above works have shown that the legionellosis develops in the stagnant zone at the base of a conventional domestic water heater due to the stratification of the water, the water at the lowest temperature being found at the bottom of the tank. More specifically, the sheet of water located between the immersed lower heating element and the bottom of the tank is rather hot, being between 30° C. and 50° C. and, consequently is quite favourable to far the proliferation of pathological bacteria, particularly the legionellosis. It thus becomes obvious that the solution to the problem is to raise the water temperature in that zone. For this purpose, an attempt to solve the above problems includes the lowering of the inner lower heating element. This solution is however not recommended because it causes scaling which may, in the long run, damage the lower heating element.

SUMMARY OF THE INVENTION

A first object of the invention is consequently to propose an electric water heater capable of eliminating the danger of bacterial proliferation and more particularly the legionellosis bacterium. A bibliographical study, on the matter, has not made it possible to find water heaters capable of preventing bacterial proliferation, that is water heaters in which the temperature can be made uniform throughout.

Another important object of the invention resides in an electric water heater having a good power efficiency while adding little overall cost to the appliance.

More specifically, the electric water heater according to the invention comprises a cylindrical tank having a vertical wall and an inwardly curved bottom, the latter defining with the wall a zone susceptible of bacterial infection; the tank being provided with an upper inner heating element and a lower inner heating element, the latter being located above the said zone of infection. The water heater is characterized in that it further comprises a heating element mounted on the tank vertical wall, outwardly thereof and at the level of the said zone, beneath the lower inner element. This outer element has a predetermined wattage which makes it capable of bringing water in the infection zone, to a temperature sufficient to eliminate the danger of such infection. In the case of the legionellosis, this outer heating element will be selected so as to be able to bring and hold the water in the infection zone rapidly at a temperature above 46° C. and preferably above 55° C.

According to a particular embodiment of the invention, the outer heating element is made up of at least one heating strip including an elongated electric resistance insulated in mica, this resistance being possibly a nickel-chrome resisting tape.

According to another embodiment, the outer heating element is made up of at least one heating strip comprising an elongated electric resistance embedded between two thin sheets of fiber glass reinforced rubber.

The invention will be better understood from the description that follows of certain preferential embodiments.

BRIEF DESCRIPTION OF THE DRAWINGS

FIG. 6 is a mounting diagram of a heating strip while

DESCRIPTION OF THE PREFERRED EMBODIMENTS

Figure 1:
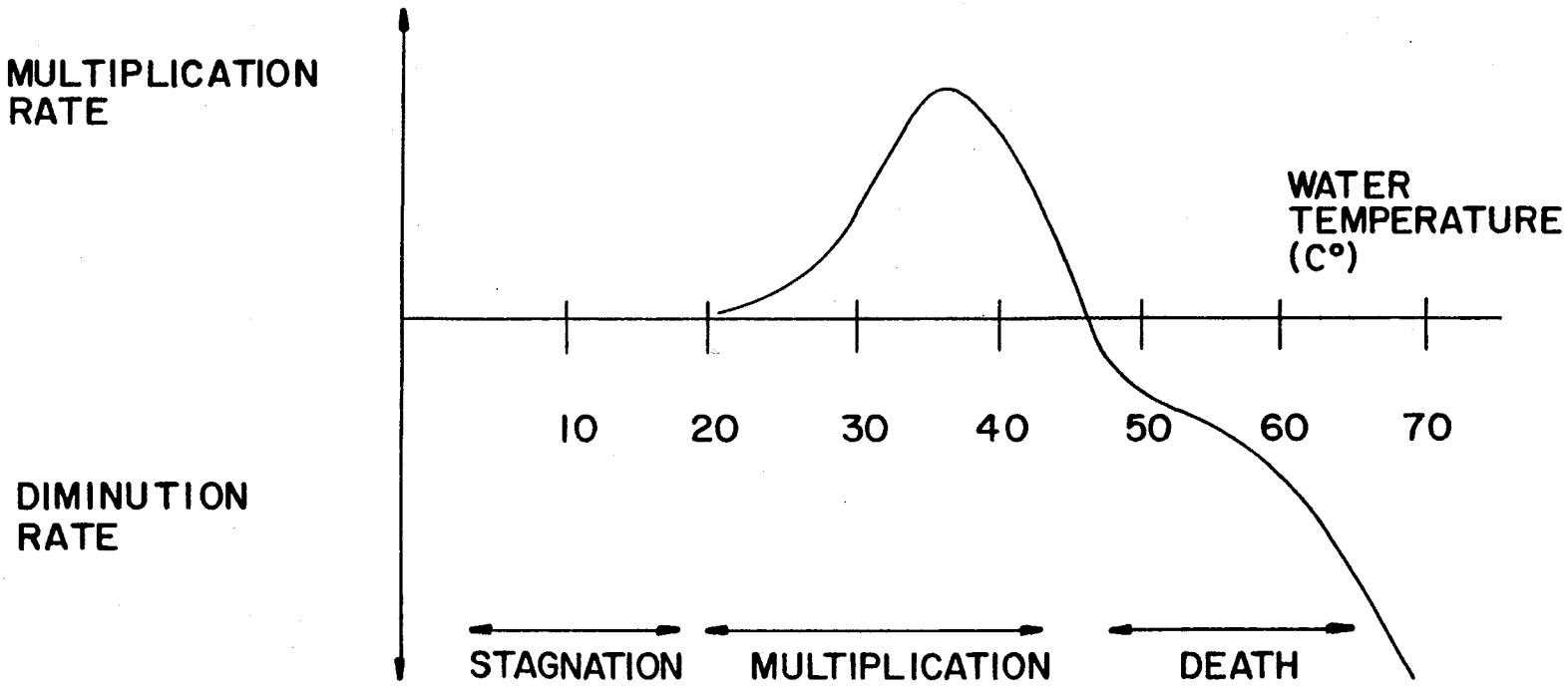
FIG. 1 is a curve illustrating how the temperature affects the legionellosis and FIG. 2 a curve indicating the time necessary for the destruction of 90% of the legionellosis.
Figure 2:
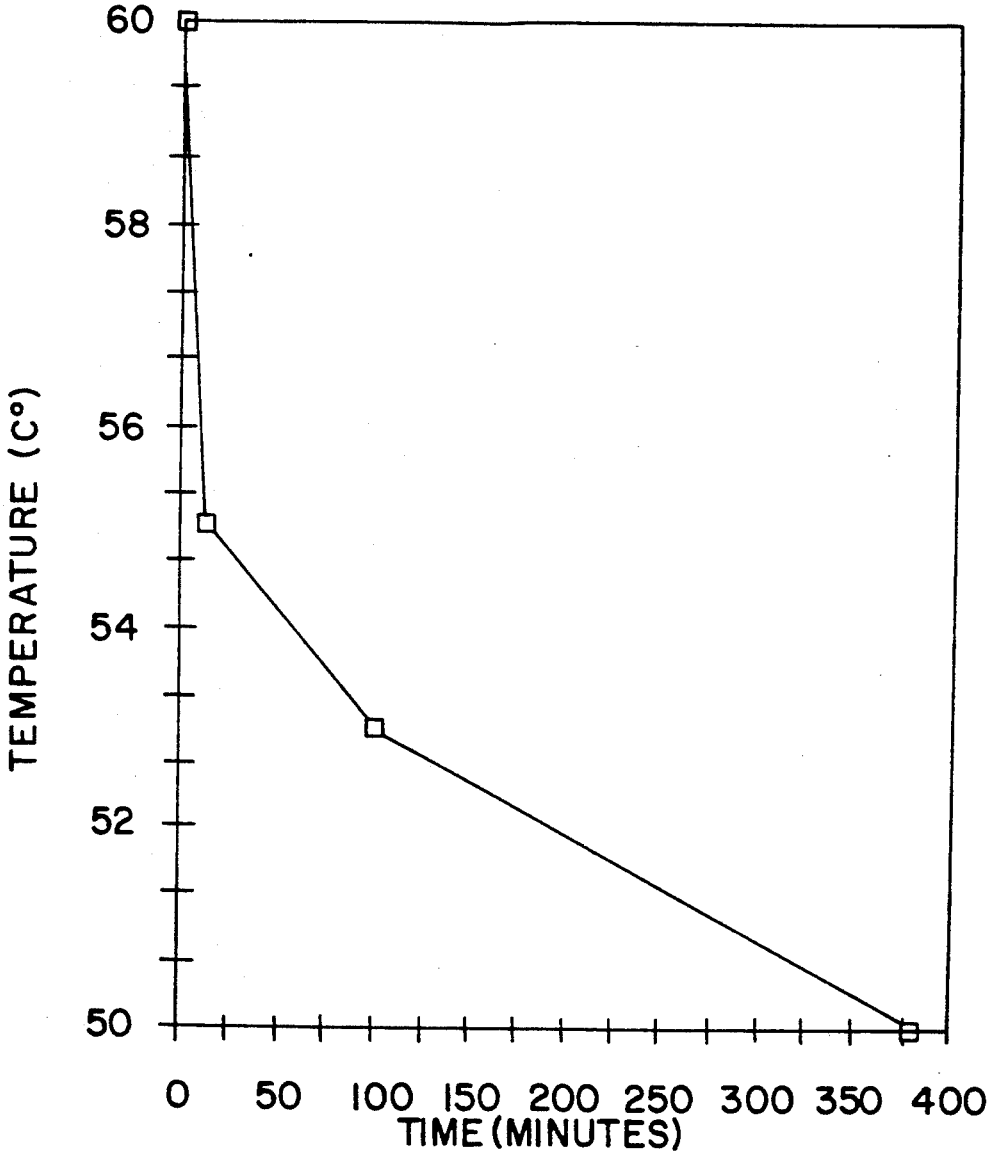

Previous studies have shown that the two critical temperatures for the proliferation of the legionellosis are, as indicated by the curve in FIG. 1, 27° C. and 46° C. The optimum proliferation temperature is 37° C. The other temperature, that is 46° C., is that at which the concentration of legionellosis in the water remains constant. At temperatures above 46° C., the cells die and the rate of destruction increases rapidly with the increasing temperature. The curve of FIG. 2 shows that an exposure of 380 minutes duration at 50° C.; 13.9 minutes at 55° C.; 0.7 minutes at 60° C. or 0.5 minutes at 66° C. make it possible to eliminate 90% of the population of legionellosis of serogroup 1, which is the most frequent. These determinations have been carried out in test tubes by microbiologists and represent the most optimistic conditions for the elimination of the bacterium. Indeed, if the traces of iron oxide and nutritive substances, the survival time could be somewhat greater than that obtained in laboratory in ideal conditions.

By using the information contained in these two graphs, the inventors have conceived a water heater in which the temperatures lie beyond the proliferation temperature zone. In order to avoid bacterial proliferation, the invention makes it possible to hold the bottom of the water heater at a bacterial destruction temperature. The improved water heater, according to the invention, also makes it possible to avoid having the water contained that the bottom of the water heater come in suspension with the contents of the rest of the water heater. Always according to the invention, the mixing of the cold inlet water with the already existing hot water is essentially limited to the lower end of the tank.

It follows from the preceeding remarks that the water heater, according to the invention, is conceived to eliminate the legionellosis by increasing the temperature in the infection zone at the base of the tank.

Figure 3:
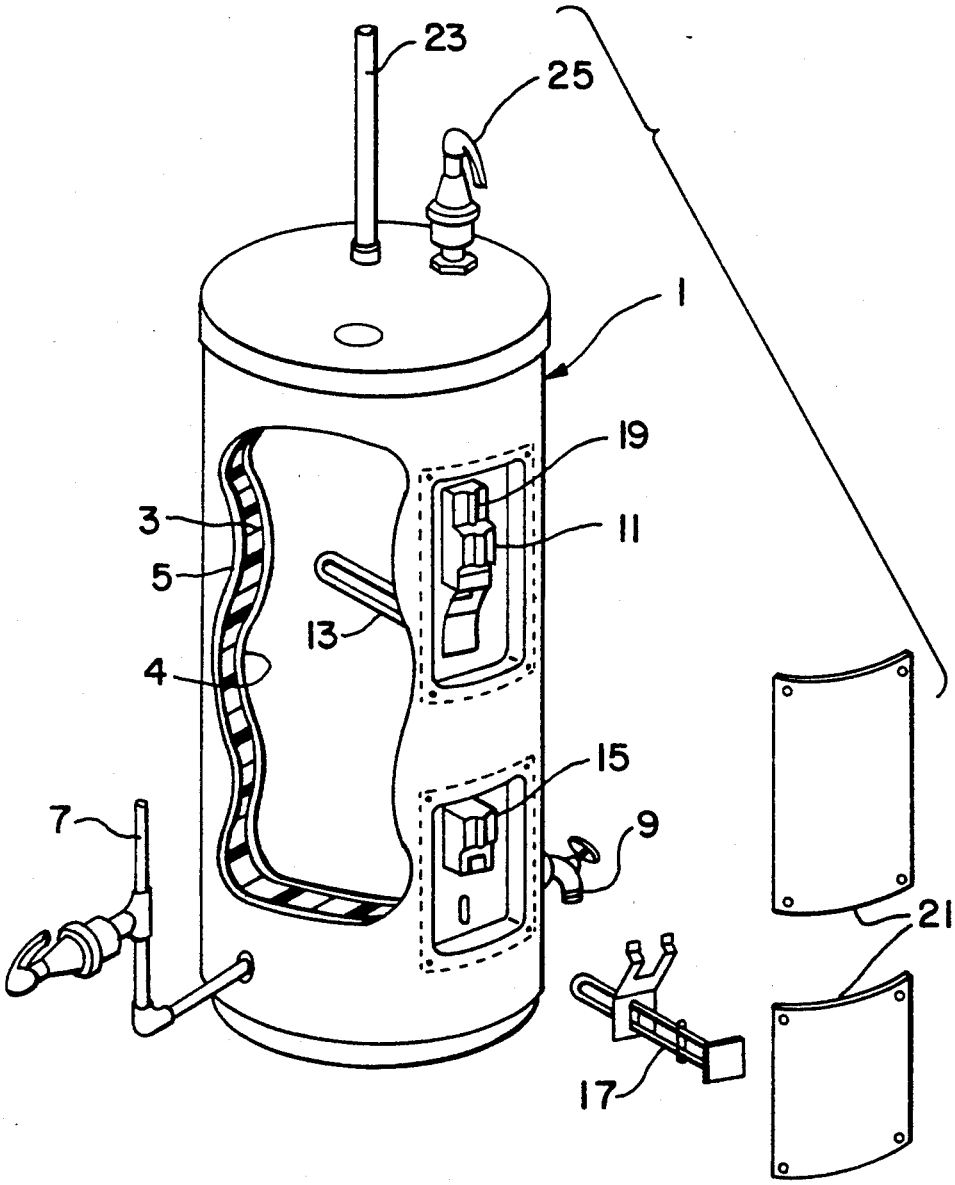
FIG. 3 PRIOR ART
FIG. 3 is a partially broken away and exploded perspective view of a conventional electric water heater.

Referring now to FIG. 3, a conventional domestic water heater 1 is illustrated comprising a tank 3 having inner and outer walls 3, 5 with an insulation layer 4 in between. The tank has a nominal capacity of 40 gallons (175 liters) or of 60 gallons (270 liters). Cold water is introduced by conduit 7 opening directly into the infection zone through a not shown diffusion. Cold water may also be admitted, from the top of the tank 1, by means of an inlet conduit, not shown, which brings the water to the bottom of the tank, as is the case with the water heater according to the invention, in order to avoid the diffusion phenomenon mentioned above. Emptying of the tank 3 is obtained with a drain valve 9. The tank is also provided with a thermostat 11 controlling the temperature of a top immersed heating element 13 and with a thermostat 15 for the control of the temperature of a lower immersed heating element 17. A device 19, near the heating element 13, limits the maximum temperature of the water in the tank. Covers 21 hide the thermostats 11 and 15. The hot water is drawn out of the tank by means of a conduit 23 and a pressure relief safely valve 25 is provided at the top. In most cases, the power of the heating elements 13 and 17 is between 3 and 4.5 kW, being connected on a 220 V power source. Thermostats 11 and 15 allow an adjustment between 50° C. and 75° C. However, the standards of the Canadian Standards Association (C.S.A.) require that the adjustment does not exceed 60° C., the thermostats being fixed to that temperature by the manufacturer.

Figure 4:
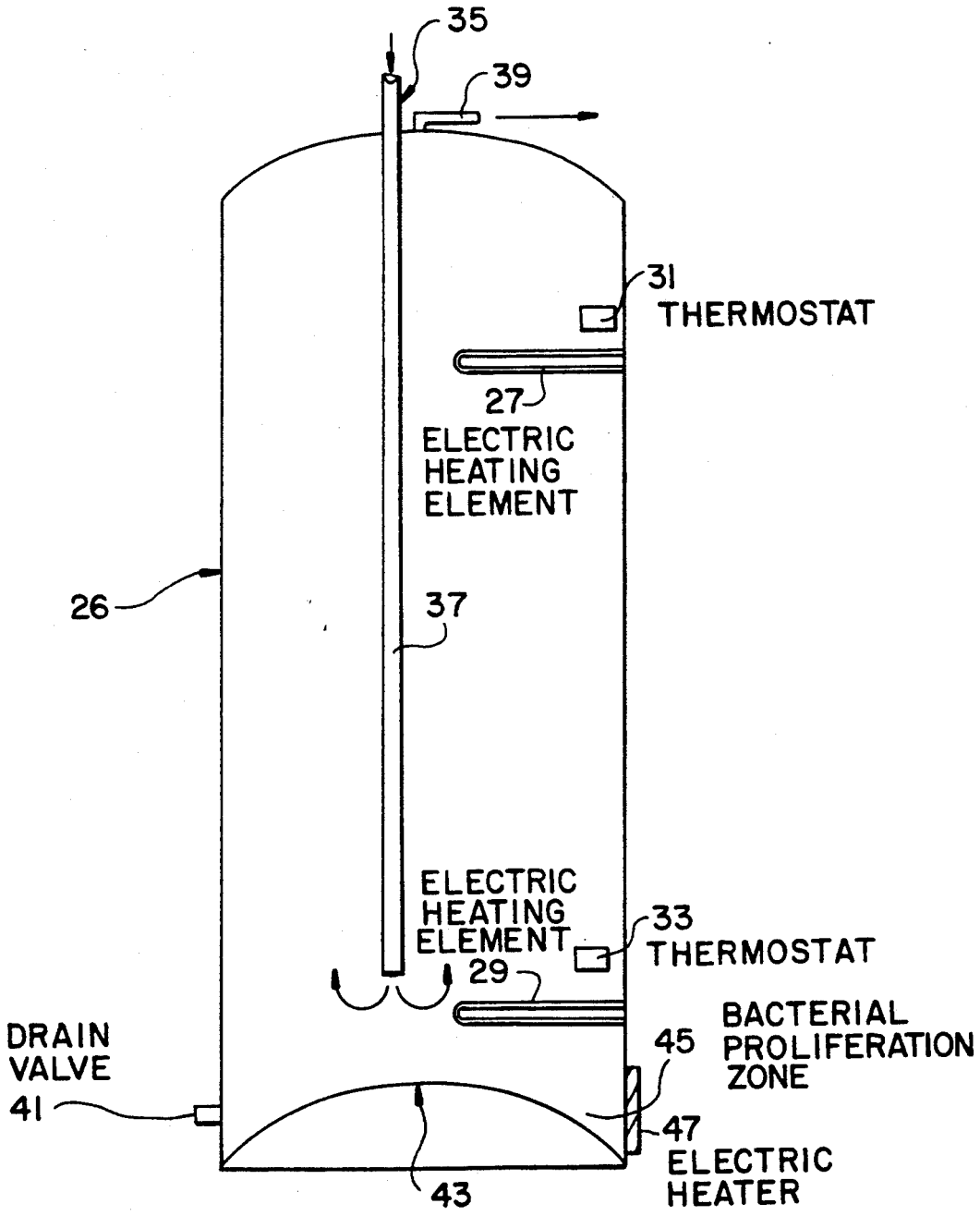
FIG. 4 is a diagrammatic vertical cross section of a conventional water heater comprising the improvement according to the invention and FIG. 5 is a transverse cross section of the latter.
Figure 5:
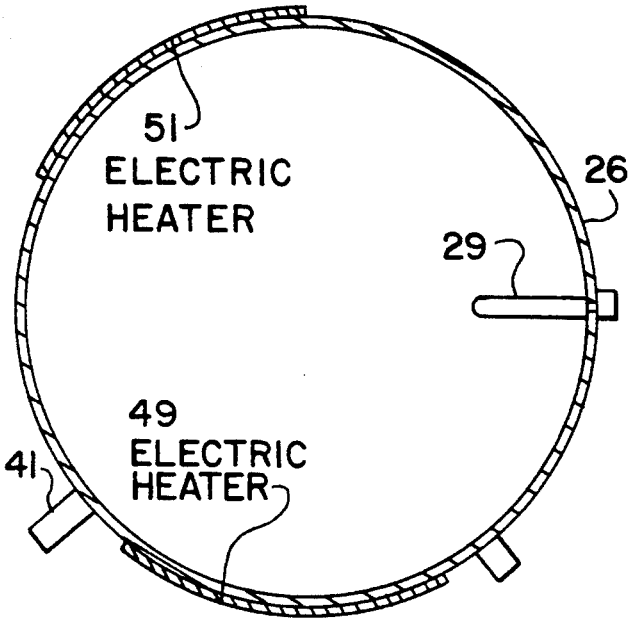

FIGS. 4 and 5 illustrate, diagrammatically, the changes made to the conventional domestic hot water heater 26 to allow the elimination, for all practical purposes, of the legionellosis.

There is shown a water heater having a capacity of 40 gallons (175 liters) provided with two immersed heating elements 27, 29 of 3 kW each controlled by thermostats 31, 33 as in known water heaters. As mentioned previously, the cold water comes in at 35 by means of a dip-tube 37 which opens slightly above the lower inner heating element 29 in a way as to avoid mixing the cold water entering the tank with the hot water which comes out through the outlet conduit 39. Drainage is obtained by means of a valve 41.

The bottom 43 of the tank is inwardly curved and defines an inner zone 45 where water, in present-day domestic water heaters, remains at a temperature of about 40° C. even when there is no water consumption. As FIG. 1 shows, it is at this temperature that the rate of proliferation of the bacteria is the largest. According to the invention, this situation is corrected by using a heating element 47 mounted on the vertical wall of the tank 26, and outwardly of it, and in front of the zone 45; this element 47 having a power sufficient for raising the water in the zone to a temperature capable of avoiding the danger that microbial infection represents; this temperature being above 46° C.

This heating element 47 may take the form of a single elongated strip completely or partially surrounding the tank, such as that described in U.S. Pat. No. 2,545,653 which, however, is used as an alternative to the immersed heating elements 27, 29. The element 47 may also take the form of two spaced strips 49, 51 disposed along the outer parameter of the tank as illustrated in FIG. 5. There is no limit as the number of strips if only that a greater number increases the cost. The distribution of the strips is selected in a way such that it provides easy access for installation, maintenance and replacement, through the usual access panel at the bottom of the water heater, considering that the latter is usually installed in a corner of the compartment defined by two adjacent walls. It follows that the axis panel will have to be enlarged to facilitate handling.

As mentioned above, an outer heating element, such as element 47, is sometimes used on water heaters as a replacement for immersion elements 29, 31 but its use is not frequent. It is indeed used mainly when aqueduct water causes limestone deposits inside the water heater that could damage the conventional immersion elements. Its advantage is that it allows heating the water directly through the metal wall of the water heater. In no way has the outer heating element been used to heat water in the zone 45 nor has there been any suggestion made in that respect.

The combination of the two inner elements 27, 29 and of the outer element 47 creates thermal fields which prevent bacterial proliferation. Outer elements 47 may be used that have a power of from 500 to 4,500 watts but it has been shown that a power in the order of 700 to 800 watts meets the requirements perfectly. At this total electric power and under power densities varying between 10 watts/in$^2$ to 40 watts/in$^2$, it is possible to limit the formation of scaling or deposits. Altogether, this combination of elements 27, 29, 47 makes it possible to retain the present design of conventional water heaters while improving the thermal fields, and this is done at a reasonable cost. The three elements should operate according to the following priorities: the top element 27 having the highest priority and the bottom element 47 having the lowest.

Two types of heating elements may be used, as alternatives. These elements are for the element 47, mica insulated heating strips and rubber embedded heating strips.

Figure 6:
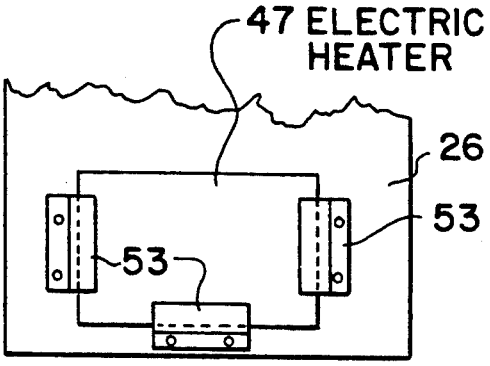
Figure 7:
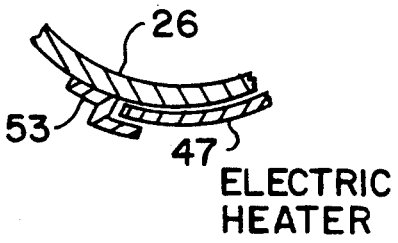
FIG. 7 is a cross section according to line VII—VII of FIG. 6.

These strips may be fixed to the outer lateral wall of the tank below the mounting strap of the immersed element 29. FIGS. 6 and 7 illustrate one manner of securing the strip 47. The latter is preshaped with a curvature greater than that of the tank such that the spring effect which develops when it is put into place may provide a good constant force with the tank. It will be slid inside the Z brackets 53, and fixed to the tank by contracting the curvature. Alternatively, the strip could be fixed directly by means of clamping screws; by means of metal hooks fixed to the tank and having tension springs, or by means of fixing holes through the strap with threaded studs welded to the tank.

This heating strip will preferably be made up of an elongated electric resistance which can be a resisting nickel-chrome tape wound around a thin rectangular band of mica. The combination thus obtained is disposed between two other mica bands and is protected by a folded metal sheath which forms the external lining. The resulting heating element has a total thickness of 3/16" to ¼" (5 to 6 mm). The limits of the operating temperature for the mica insulated heating strips are higher than those of the rubber embedded heating strips. The operating temperature of these mica insulated strips are usually higher than the temperature of the surface to be heated since mica is not a very good heat conductor and the inner assembly of the various layers is simply achieved by contact. On the other hand, the mica insulated strips are quite polyvalent since they can be manufactured in a large range of dimensions (width and length), of voltages (up to 480 V) and of arrangement of electric terminals.

Alternatively, the heating element 47 may comprise one or two heating strips. The latter are made up of a resistance element embedded between two thin sheets of fiber glass reinforced rubber (neoprene or silicon). The heating element is either a sinuous resisting wire or a metallic ribbon of the etched-foil type. The etched type of foil has the advantage of a better distribution of heat and is better for mass production since its manufacture process resembles that of printed circuits used in electronics (chemical machining).

The total thickness of etched-foil elements may be 0.018" (0.46 mm) and their maximum power density may reach 80 W/in$^2$ (12 W/cm$^2$). The maximum operating temperatures may be of 260° C. (500° F.) for silicon and 120° C. (250° F.) for neoprene. The rubber heating strips are often pre-glued with a semi-permanent adhesive that provides a very strong thermal contact with the surface to be heated. The latter feature and their very small thickness provides operating temperatures that are quite close to the temperature of the surface to be heated.

IRC Canada company has a silicon rubber strip of the etched-foil type pre-glued with a semi-permanent adhesive that ensures a very good thermal contact with the surface to be heated while allowing relatively easy replacement. According to the manufacturer, it is relatively easy to remove a defective element in order to replace it. The glue used is inert and should not cause any corrosion problem to the tank. However, the price of these strips are normally greater than that of the mica strips.

A certain number of experimental trials have been carried out with a silicon rubber self-adhesive heating strip having a density of 10 W/in$^2$ (1.55 W/cm$^2$). This power density respects the limits allowed under C.S.A. Standard C191. Under this condition, the surface of the element must be 80 in$^2$ (516 cm$^2$) for a power of 800 W and the surface density specified above. The available surface on the sidewall of the water heater tank is limited in height by the distance between the lower weld of the tank and the bracket of the actual lower element (approximately 5" or 13 cm) and in width by the distance between the longitudinal weld of the tank and the position of the drain of the water heater (approximately 17" or 43 cm). The dimensions to remember for a heating element which would be installed on the sidewall of the water heater are therefore of 5" in height and 16" in length (13 cm×14 cm).

In its present configuration, the conventional water heater is an appliance which has reached a high degree of development in respect of its mechanical conception. Thus, the dimensions of the outer sheathing of the water heaters have been optimized in order to take into account, among others, transportation restrictions. It is therefore important that the installation of a third heating element does not change the overall dimensions of the water heater. In order to be so, the heating element must be relatively thin (1 cm and less).

As it is impossible to design a heating element which has a 15-year lifespan and a full proof reliability, it is essential to provide means for an easy replacement of the heating element. In the case of an installation on the outer sidewall of the tank, it is of particular interest that the maintenance be made possible from the present access door to the lower immersed element. The access door could, for instance, be widened so as to cover up to one third of the circumference of the water heater. It is absolutely necessary that all of the maintenance operations be made possible only from the front of the water heaters since the latter are often installed in a corner between two perpendicular walls, as said before.

Finally, the addition of element 47 at the base of the water heater has obviously caused an additional heat loss which may be reduced in various ways. It is possible, for instance, to install the water heater on an insulated base, to provide a heat trap at the hot water outlet pipe, to increase the insulation of the water heater during its manufacture, and to use an insulating blanket. This question has however nothing to do with the present invention.

What is claimed is:

1. An electric water heater comprising a cylindrical tank having a vertical wall and an inwardly curved bottom, said bottom defining with said wall an annular, stagnant water zone susceptible of bacterial contamination, said tank being provided with a cold water inlet conduit opening into said tank close to the bottom thereof, a hot water outlet conduit on top of said tank, an upper immersion heating element controlled by a first thermostat and a lower immersion heating element controlled by a second thermostat, said lower heating element being located above said annular zone of contamination, wherein the tank further comprises at least one additional outer heating element mounted on said tank vertical wall, outwardly thereof and at the level of said annular zone of contamination below said lower immersion element, said outer heating element being activable to bring water in said annular zone of contamination to a temperature sufficient to eliminate the danger of such bacterial contamination, and wherein said first and second thermostats are adjusted so as to operate according to the following priorities: said upper immersion heating element is activated first; and said bottom immersion heating element and said outer heating element are activated subsequently.

2. An electric water heater as claimed in claim 1, wherein said outer heating element is capable of rapidly raising and holding water in said zone to and at a temperature of at least 46° C.

3. An electric water heater as claimed in claim 2, wherein said outer heating element is capable of rapidly raising and holding water in said zone to and at a temperature in the order of 55° C.

4. An electric water heater as claimed in claim 3, wherein said outer heating element is made up of at least one heating strip including an elongated electric resistance.

5. An electric water heater as claimed in claim 2, wherein said outer heating element is made up of at least one heating strip including an elongated electric resistance.

6. An electric water heater as claimed in claim 1, wherein said outer heating element is made up of at least one heating strip including an elongated electric resistance.

7. An electric water heater as claimed in claim 6, wherein said resistance is a nickel-chrome resisting tape.

8. An electric water heater as claimed in claim 6, wherein said outer heating element has a total power comprised between 500 and 4,500 watts.

9. An electric water heater as claimed in claim 6, wherein said outer heating element has a total power in the order of 700 to 800 watts.

10. An electric water heater as claimed in claim 9, wherein said outer heating element has a power density comprised between 10 watts/in$^2$ and 40 watts/in$^2$.

11. An electric water heater as claimed in claim 4, wherein said elongated electric resistance is an elongated metallic ribbon of the etched-foil type having a thickness in the order of 0.018" and a maximum power density in the order of 80 watts/in$^2$.

* * * * *